US006179026B1

(12) United States Patent
Lopez

(10) Patent No.: US 6,179,026 B1
(45) Date of Patent: Jan. 30, 2001

(54) CONCEALABLE WALLET WITH KEY SECURING MECHANISM

(76) Inventor: Jacqueline Lopez, 11266 Cornish Ave., Lynwood, CA (US) 90262

( * ) Notice: Under 35 U.S.C. 154(b), the term of this patent shall be extended for 0 days.

(21) Appl. No.: 09/388,586

(22) Filed: Sep. 2, 1999

(51) Int. Cl.[7] ..... A45C 1/06

(52) U.S. Cl. ..... 150/134; 150/106; 150/112; 24/3.6; 206/38.1

(58) Field of Search ..... 150/134, 137, 150/140, 147, 106, 119, 131, 138; 24/3.2, 3.6, 3.13; 224/222, 3.2, 3.6, 3.13; 206/38.1, 38

(56) References Cited

U.S. PATENT DOCUMENTS

| | | | | |
|---|---|---|---|---|
| 1,485,490 | * | 3/1924 | Dorsey | 206/37 |
| 1,614,607 | * | 1/1927 | Ewen | 27/37.3 |
| 2,037,338 | * | 4/1936 | Rhodes | 24/3.6 |
| 2,503,847 | * | 4/1950 | Shanahan | 224/638 |
| 2,816,434 | * | 12/1957 | Olson | 206/38.1 |
| 3,056,180 | * | 10/1962 | Gink | 206/37 X |
| 3,119,429 | * | 1/1964 | Stiller et al. | 206/37.3 |
| 3,322,311 | * | 5/1967 | Homer | 224/222 |
| 3,326,258 | * | 6/1967 | Stucker | 150/106 X |
| 4,570,688 | * | 2/1986 | Williams | 150/134 |
| 4,899,395 | | 2/1990 | Spector . | |
| 5,189,738 | | 3/1993 | Mitchell . | |
| 5,255,392 | | 10/1993 | Stanislaw . | |
| 5,708,978 | | 1/1998 | Johnsrud . | |
| 5,799,336 | | 9/1998 | Cooper . | |
| 5,832,540 | | 11/1998 | Knight . | |
| 6,082,600 | * | 7/2000 | Angus et al. | 224/269 |

* cited by examiner

*Primary Examiner*—Allan N. Shoap
*Assistant Examiner*—Tri M. Mai
(74) *Attorney, Agent, or Firm*—Joseph N. Breaux

(57) ABSTRACT

A wallet system including a sealable item concealment pouch, a pouch securing strap assembly, and a key securing mechanism. The key securing mechanism is includes a securing chain and a spring biased key gripping assembly. The spring biased key gripping assembly is positioned within an open topped pocket en an exterior surface of the sealable item concealment pouch and includes a resilient channel member having a key insertion slot defined between first and second key gripping members, the first and second key gripping members being biased toward each other by first and second springs such that a key placed within the key insertion slot is gripped between the first and second key gripping members.

1 Claim, 2 Drawing Sheets

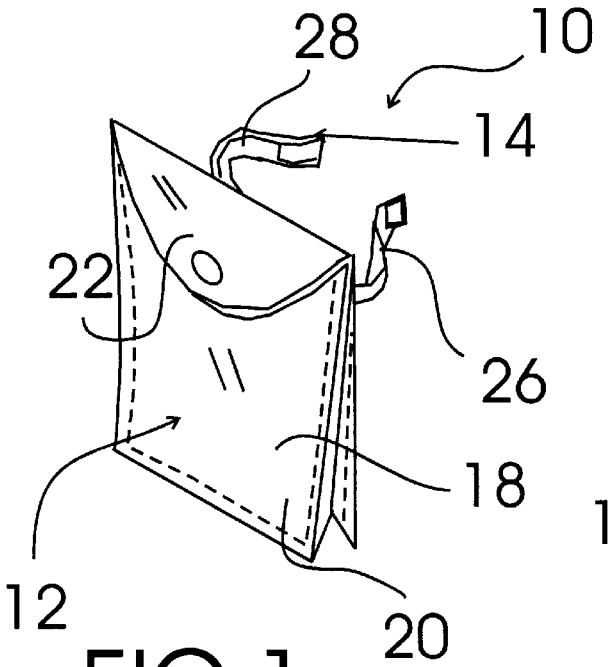
FIG.1
FIG.3
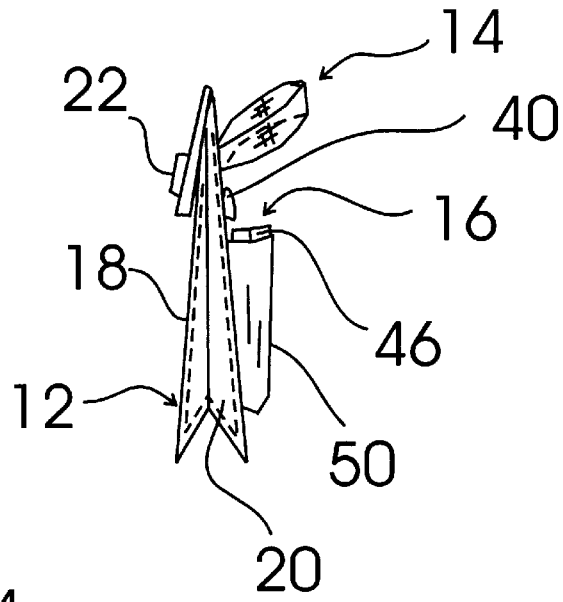
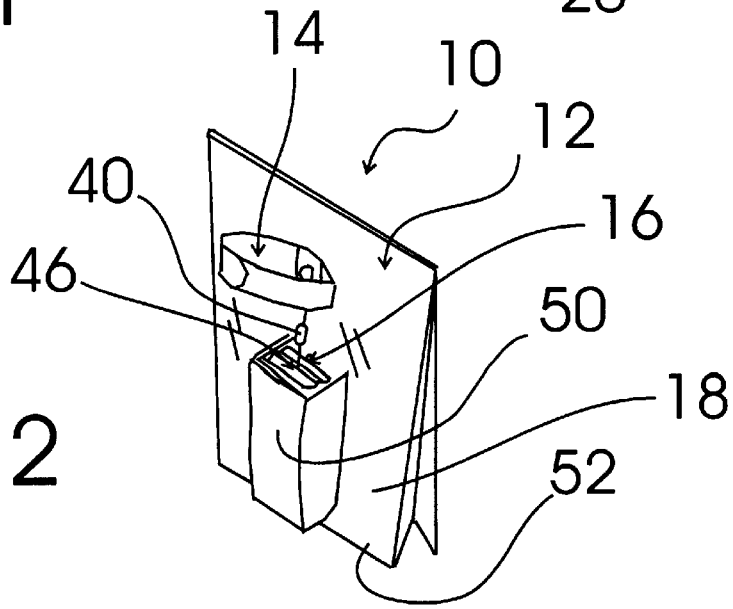
FIG.2

FIG.6
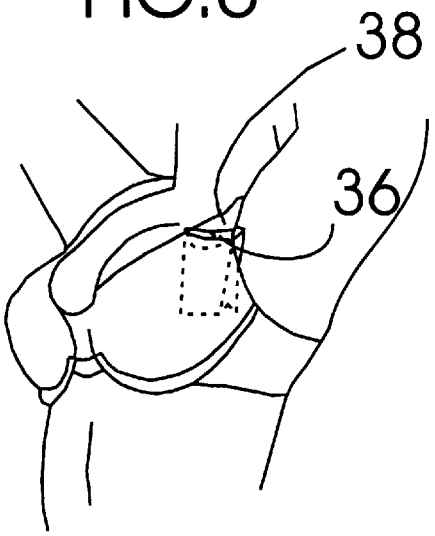
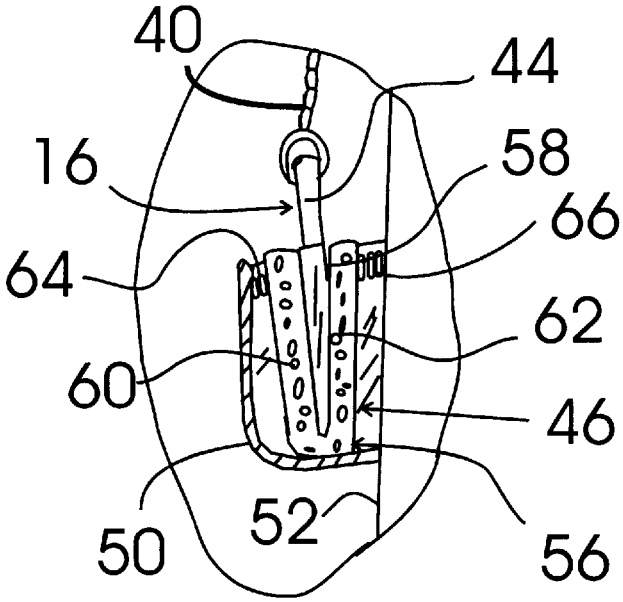
FIG.5
FIG.4
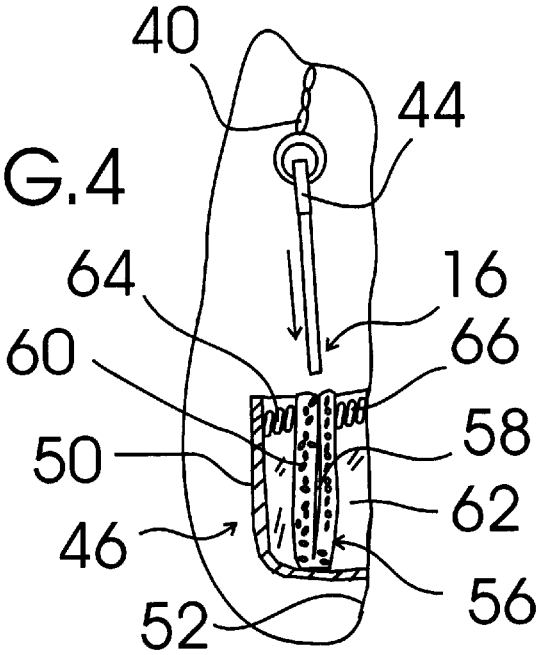

CONCEALABLE WALLET WITH KEY SECURING MECHANISM

TECHNICAL FIELD

The present invention relates to wallets and the like and more particularly to a concealable wallet with key securing mechanism that includes a sealable item concealment pouch, a pouch securing strap assembly, and a key securing mechanism including a securing chain and a spring biased key gripping assembly; the spring biased key gripping assembly including a resilient channel member having a key insertion slot defined between first and second key gripping members, the first and second key gripping members being biased toward each other by first and second springs such that a key placed within the key insertion slot is gripped by the first and second key gripping members; the spring biased key gripping assembly being positioned within an open topped pocket on an exterior surface of the sealable item concealment pouch.

BACKGROUND ART

It is often difficult for women to carry identification, money, credit cards and one or more keys without the need for carrying a purse. It would be desirable, therefore, to have a concealable wallet wIth a key securIng mechanism that could be secured to the brassiere strap of a user and positioned between the brassiere cup and breast of a user to allow a user to comfortably and discretely carry necessary items without the need for a bulky purse.

GENERAL SUMMARY DISCUSSION OF INVENTION

It is thus an object of the invention to provide a concealable wallet with key securing mechanism that includes a sealable item concealment pouch, a pouch securing strap assembly, and a key securing mechanism including a securing chain and a spring biased key gripping assembly; the spring biased key gripping assembly including a resilient channel member having a key insertion slot defined between first and second key gripping members, the first and second key gripping members being biased toward each other by first and second springs such that a key placed within the key insertion slot is gripped by the first and second key gripping members; the spring biased key gripping assembly being positioned within an open topped pocket on an exterior surface of the sealable item concealment pouch.

Accordingly, a concealable wallet with key securing mechanism is provided. The concealable wallet with key securing mechanism includes a sealable item concealment pouch, a pouch securing strap assembly, and a key securing mechanism including a securing chain and a spring biased key gripping assembly; the spring biased key gripping assembly including a resilient channel member having a key insertion slot defined between first and second key gripping members, the first and second key gripping members being biased toward each other by first and second springs such that a key placed within the key insertion slot is gripped by the first and second key gripping members; the spring biased key gripping assembly being positioned within an open topped pocket on an exterior surface of the sealable item concealment pouch.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is a perspective view of an exemplary embodiment of the concealable wallet with key securing mechanism of the present invention showing the sealable item concealment pouch and the pouch securing strap assembly.

FIG. 2 is a second perspective view of the exemplary concealable wallet with key securing mechanism of FIG. 1 showing the sealable item concealment pouch, the pouch securing strap assembly, and the key securing mechanism including the securing chain and the spring based key gripping assembly; the spring biased key gripping assembly including a resilient channel member having a key insertion slot defined between first and second key gripping members, the first and second key gripping members being biased toward each other by first and second springs such that a key placed within the key insertion slot is gripped by the first and second key gripping members; the spring biased key gripping assembly being positioned within an open topped pocket on an exterior surface of the sealable item concealment pouch.

FIG. 3 is a side plan view of the concealable wallet with key securing mechanism of FIG. 1.

FIG. 4 is a sectional view of the key securing mechanism with a representative key attached to the securing chain and positioned above the key insertion slot of the spring biased key gripping assembly.

FIG. 5 is a sectional view of the key securing mechanism with a representative key attached to the securing chain and positioned within the key Insertion slot of the spring biased key gripping assembly.

FIG. 6 is a perspective view of the concealable wallet with key securing mechanism of FIG. 1 in use with the pouch securing strap assembly secured around one of the straps of a representative brassiere and the sealable item concealment pouch and the key securing mechanism positioned between one of the brassiere cups and a breast of a user.

EXEMPLARY MODE FOR CARRYING OUT THE INVENTION

FIGS. 1–3 show an exemplary embodiment of the concealable wallet with key securing mechanism of the present invention generally designated 10. Concealable wallet with key securing mechanism 10 includes a flap sealable item concealment pouch, generally designated 12; a pouch securing strap assembly, generally designated 14; and a key securing mechanism, generally designated 16. Flap sealable item concealment pouch 12 is constructed of leather and includes a pouch member 18 that defines an item concealment compartment 20 (shown in dashed lines) that is sealable with a snap securable flap 22. Pouch securing strap assembly 14 includes first and second securing straps 26,28 that are securable together with hook and pile fastener section 30,32 to form, with reference now to FIG. 6, a closed loop 36 around a brassiere strap 38.

Referring back to (FIGS. 1–3), key securing mechanism 16 includes a securing chain 40 having one end permanently affixed to pouch member 18 and a free end securable to a key 14 (see FIGS. 4 and 5). Key securing mechanism 16 also includes a spring biased key gripping assembly, generally designated 46. Referring now to FIGS. 4 and 5, in this embodiment spring biased key gripping assembly 46 is mounted within an open topped pocket 50 provided on an exterior surface 52 of sealable item concealment pouch 12.

Spring biased key gripping assembly 46 includes a resilient channel member, generally designated 56, having a key insertion slot 58 defined between first and second key gripping members 60,62. First and second key gripping members 60,62 are biased toward each other by first and second springs 64,66 such that a key 44 placed within key insertion slot 58 is gripped by first and second key gripping members 60,62.

It can be seen from the preceding description that a concealable wallet with key securing mechanism has been provided that includes a sealable item concealment pouch, a pouch securing strap assembly, and a key securing mechanism including a securing chain and a spring biased key gripping assembly; the spring biased key gripping assembly including a resilient channel member having a key insertion slot defined between first and second key gripping members, the first and second key gripping members being biased toward each other by first and second springs such that a key placed within the key insertion slot is gripped by the first and second key gripping members; the spring biased key gripping assembly being positioned within an open topped pocket on an exterior surface of the sealable item concealment pouch.

It is noted that the embodiment of the concealable wallet with key securing mechanism described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A concealable wallet with key securing mechanism comprising:

a closable item concealment pouch;

a pouch securing strap assembly; and a key securing mechanism including a securing chain attached to said sealable item concealment pouch and a spring biased key gripping assembly;

said spring biased key gripping assembly including a resilient channel member having a key insertion slot defined between first and second key gripping members, said first and second key gripping members being biased toward each other by first and second springs such that a key placed within said key insertion slot is gripped between said first and second key gripping members;

said spring biased key gripping assembly being positioned within an open topped pocket provided on an exterior surface of said sealable item concealment pouch.

* * * * *